United States Patent [19]

Gaines et al.

[11] Patent Number: 4,559,785

[45] Date of Patent: Dec. 24, 1985

[54] BOILER CONTROL

[75] Inventors: Larry D. Gaines; Merle R. Likins, Jr., both of Bartlesville, Okla.

[73] Assignee: Phillips Petroleum Company, Bartlesville, Okla.

[21] Appl. No.: 690,087

[22] Filed: Jan. 9, 1985

[51] Int. Cl.[4] ..... F01K 13/00

[52] U.S. Cl. ..... 60/676; 60/664; 122/448 B

[58] Field of Search ..... 60/664, 667, 676; 122/448 B, 448 R; 236/14

[56] References Cited

U.S. PATENT DOCUMENTS 3,837,167 9/1974 Durrant et al. ..... 60/664
4,069,675 1/1978 Adler et al. ..... 60/676 X
4,418,541 12/1983 Russell ..... 60/676 X

FOREIGN PATENT DOCUMENTS 723305 3/1980 U.S.S.R. ..... 122/448 R

*Primary Examiner*—Stephen F. Husar
*Attorney, Agent, or Firm*—French and Doescher

[57] ABSTRACT

Boiler optimization is included in on-line control of parallel boilers by multiplying the total heat per unit time which must be supplied to all parallel boilers by the percentage of the total heat which should be supplied to each boiler by primary and secondary fuels in order to substantially maximize energy efficiency. The result of such multiplication is the heat per unit time which should be supplied to each boiler by the primary and secondary fuels. The fuel and air supplied to each boiler is controlled so as to supply the thus determined heat per unit time which not only results in maintenance of a desired header pressure but also results in substantially maximizing energy efficiency of the parallel boilers even where multiple fuels are combusted to supply heat.

4 Claims, 3 Drawing Figures

BOILER CONTROL

This invention relates to control of parallel boilers which supply steam to a common header. In one aspect this invention relates to method and apparatus for optimizing the operation of parallel boilers to which multiple fuels are supplied for combustion.

Boilers are often utilized to supply steam for a process. In many cases, parallel boilers are utilized to supply steam to a common header. The various steam users then draw steam from the common header.

Steam usage by a process will usually vary as a function of time. However, it is usually desirable to maintain a substantially constant header pressure even though the steam usage varies. This is generally accomplished by varying the firing rate for the parallel boilers so as to maintain a substantially constant header pressure even when steam usage varies.

Where parallel boilers are utilized, the steam header pressure may be maintained by varying the firing rate of all parallel boilers by the same amount. As an example, if two parallel boilers are employed, the boilers could be operated so as to always supply one-half of the steam flow required to maintain the desired header pressure.

It has been found that, because of differences in boiler construction and operating characteristics, operation of parallel boilers so as to supply equal portions of the required load results in less than optimum energy usage. At some firing rates it might be desirable to have a first boiler supply 60% of the steam and a second boiler supply 40% of the steam while at other firing rates it might be desirable to have the first boiler supply 45% of the steam and the second boiler supply 55% of the steam. The determination of how much steam should be supplied by each boiler (which may be expressed in terms of steam flow rate or heat per unit time or some other desired parameter) in order to maintain maximum energy efficiency is generally referred to as boiler optimization.

The complexity of boiler optimization is increased when multiple fuels have different BTU values and different cost are supplied to each of the parallel boilers. Under these circumstances, there will not only be an optimum steam flow from each boiler but there will also be some optimum mix of the fuels from the standpoint of cost and efficiency.

It is thus an object of this invention to provide method and apparatus for optimizing the operation of parallel boilers to which multiple fuels are supplied for combustion.

In accordance with the present invention, method and apparatus is provided whereby the optimum mix of multiple fuels provided to a boiler is determined for each of the parallel boilers. The results of this optimization are utilized to optimize each boiler with respect to the steam to be supplied by each boiler. Based on the results of this optimization, the multiple fuels and air supplied to each boiler are controlled so as to supply sufficient heat to each boiler to maintain a desired header pressure and also substantially maximize the energy efficiency of the parallel boilers employing multiple fuels.

Other objects and advantages of the invention will be apparent from the foregoing brief description of the invention and the claims as well as the detailed description of the drawings which are briefly described as follows:

The invention is illustrated and described in terms of two boilers. However, the invention is applicable to more than two parallel boilers and would generally be applied to more than two parallel boilers.

The invention is also illustrated and described in terms of the same two fuels being supplied to each of the two parallel boilers. However, the invention is applicable to more than two fuels and also different fuels could be supplied to each of the parallel boilers. Also, more than two fuels could be supplied to the boilers.

Figure 1:
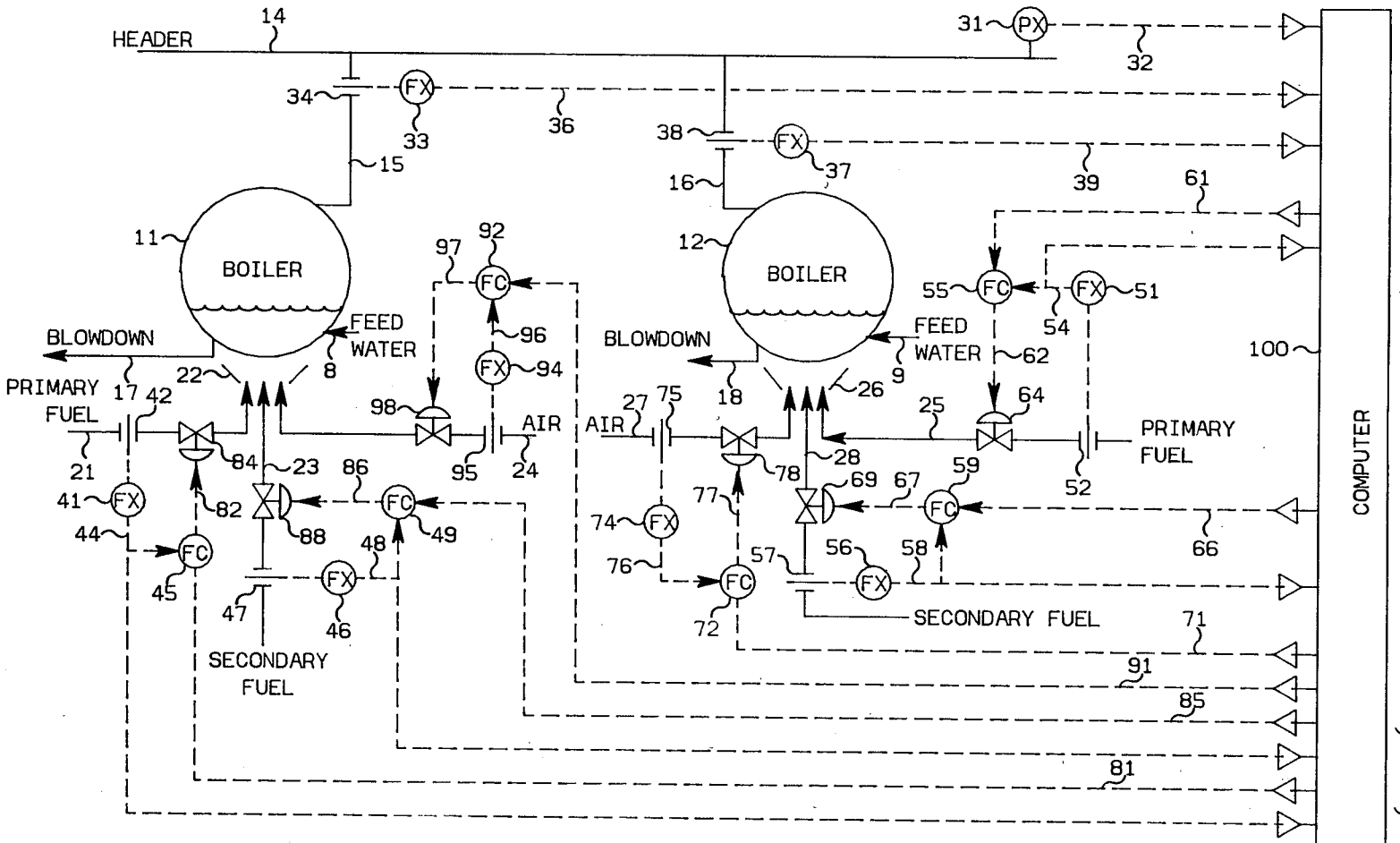
FIG. 1 is a diagrammatic illustration of two boilers supplying steam to a common header and the associated control system of the present invention.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that, if a flow is measured in pneumatic form, it must be transduced to electrical form if it is to be transmitted in electrical form by a flow transducer. Also, transducing of the signals form analog from to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate are compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, a boiler 11 and a boiler 12 are illustrated. Water is provided to boilers 11 and 12 through conduits 8 and 9 respectively. Boiler 11 supplies steam to the common header 14 through conduit means 15. In like manner, boiler 12 supplies steam to the common header 14 through conduit means 16. A blowdown stream is withdrawn from boiler 11 through conduit 17. In like manner, a blowdown stream is withdrawn from boiler 12 through conduit 18.

A primary fuel is supplied through conduit 21 to the burner 22 associated with the boiler 11. A secondary fuel is supplied through conduit 23. Air is supplied to the burner 22 through conduit 24. The combustion of the fuel flowing through conduits 21 and 23 with the air flowing through conduit 24 at the burner 22 supplies heat to the boiler 11.

In like manner, a primary fuel is supplied through conduit 25 to the burner 26 associated with the boiler 12. A secondary fuel is supplied through conduit 28. Air is supplied through conduit 27 to the burner 26. The combustion of the fuel flowing through conduits 25 and 28 with the air flowing through conduit 27 at the burner 26 supplies heat to the boiler 12.

The primary fuel would typically be a high BTU fuel gas or fuel oil. The secondary fuel might be a lower cost, lower BTU value fuel or might be a free or very low cost waste gas. Again, as previously stated, different primary fuels might be supplied to the boilers 11 and 12 and also different secondary fuels might be supplied. Also, additional fuels might be supplied if desired. However, it is noted that usually the primary fuels will be the same and the secondary fuels will be the same because the boilers will be located so as to generally have access to the same fuels.

The parallel boiler system described to this point is conventional. Additional equipment such as pumps and additional control components would typically be associated with the parallel boiler system but such additional equipment and components have not been illustrated since they play no part in the description of the present invention.

In general, control of the parallel boiler system according to the present invention is accomplished by using process measurements to establish six control signals. The process measurements will first be described and then the use of the control signals will be described. Thereafter, the manner in which the process measurements are utilized to generate the control signals will be described.

Pressure transducer 31 in combination with a pressure sensing device, which is operably located in the header 14, provides an output signal 32 which is representative of the actual header pressure. Signal 32 is provided from the pressure transducer 31 as an input to computer 100.

Flow transducer 33 in combination with the flow sensor 34, which is operably located in conduit 15, provides an output signal 36 which is representative of the actual flow rate of steam through conduit 15. Signal 36 is provided from the flow transducer 34 as an input to computer 100.

In like manner, flow transducer 37 in combination with the flow sensor 38, which is operably located in conduit 16, provides an output signal 39 which is representative of the actual flow rate of steam through conduit 16. Signal 39 is provided from flow transducer 37 as an input to computer 100.

Flow transducer 41 in combination with the flow sensor 42, which is operably located in conduit 21, provides an output signal 44 which is representative of the actual flow rate of the primary fuel through conduit 21. Signal 44 is provided as the process variable input to the flow controller 45 and is also provided as an input to computer 100.

Flow transducer 46 in combination with the flow sensor 47, which is operably located in conduit 23, provides an output signal 48 which is representative of the actual flow rate of the secondary fuel through conduit 23. Signal 48 is provided as the process variable input to the flow controller 49 and is also provided as an input to computer 100.

Flow transducer 51 in combination with the flow sensor 52, which is operably located in conduit 25, provides an output signal 54 which is representative of the actual flow rate of the primary fuel through conduit 25. Signal 54 is provided as the process variable input to the flow controller 55 and is also provided as an input to computer 100.

Flow transducer 56 in combination with the flow sensor 57, which is operably located in conduit 28, provides an output signal 58 which is representative of the actual flow rate of the secondary fuel through conduit 28. Signal 58 is provided as the process variable input to the flow controller 59 and is also provided as an input to computer 100.

In response to the described input signals, computer 100 provides six output control signals. A brief description of each of these process control signals and the manner in which it is utilized for process control follows.

Signal 61 is representative of the desired flow rate of primary fuel through conduit 25. Signal 61 is supplied as the set point input to the flow controller 55.

In response to signals 61 and 54, flow controller 55 provides an output signal 62 which is responsive to the difference between signals 61 and 54. Signal 62 is scaled so as to be representative of the position of the control valve 64, which is operably located in conduit means 25, required to maintain the actual flow rate of primary fuel through conduit 25 substantially equal to the desired flow rate represented by signal 61. Signal 62 is provided from the flow controller 55 as the control signal for control valve 64 and control valve 64 is manipulated in response thereto.

Signal 66 is representative of the desired flow rate of secondary fuel through conduit 28. Signal 66 is supplied as the set point input to the flow controller 59.

In response to signals 66 and 58, flow controller 59 provides an output signal 67 which is responsive to the difference between signals 66 and 58. Signal 67 is scaled so as to be representative of the position of the control valve 69, which is operably located in conduit means 28, required to maintain the actual flow rate of secondary fuel through conduit 28 substantially equal to the desired flow rate represented by signal 66. Signal 67 is provided from the flow controller 59 as the control signal for control valve 69 and control valve 69 is manipulated in response thereto.

Signal 71 is representative of the flow rate of the air through conduit 27 required for complete combustion of the fuels flowing through conduits 25 and 28. It is noted that, in some cases, it may be desired to supply excess air. The manner in which that may be accomplished will be described more fully hereinafter. Signal 71 is provided as the set point input to the flow controller 72.

Flow transducer 74 in combination with the flow sensor 75, which is operably located in conduit 27, provides an output signal 76 which is representative of the actual flow rate of air through conduit means 27. Signal 76 is supplied from the flow transducer 74 as the process variable input to the flow controller 72.

In response to signals 71 and 76, the flow controller 72 provides an output signal 77 which is responsive to the difference between signals 71 and 76. Signal 77 is scaled so as to be representative of the position of the control valve 78, which is operably located in conduit 27, required to maintain the actual flow rate of air through conduit 27 substantially equal to the desired flow rate represented by signal 71. Signal 77 is provided from the flow controller 72 as a control signal for the control valve 78 and the control valve 78 is manipulated in response thereto.

Signal 81 is representative of the desired flow rate of primary fuel through conduit 21. Signal 81 is supplied as the set point input to the flow controller 45.

In response to signals 81 and 44, flow controller 45 provides an output signal 82 which is responsive to the difference between signals 81 and 44. Signal 82 is scaled so as to be representative of the position of the control valve 84, which is operably located in conduit 21, required to maintain the actual flow rate of primary fuel through conduit 21 substantially equal to the desired flow rate represented by signal 81. Signal 82 is provided from the flow controller 45 as the control signal for control valve 84 and control valve 84 is manipulated in response thereto.

Signal 85 is representative of the desired flow rate of secondary fuel through conduit 23. Signal 85 is supplied as the set point input to the flow controller 49.

In response to signals 85 and 48, flow controller 49 provides an output signal 86 which is responsive to the difference between signals 85 and 48. Signal 86 is scaled so as to be representative of the position of the control valve 88, which is operably located in conduit 23, required to maintain the actual flow rate of primary fuel through conduit 23 substantially equal to the desired flow rate represented by signal 85. Signal 86 is provided from the flow controller 49 as the control signal for control valve 88 and control valve 88 is manipulated in response thereto.

Signal 91 is representative of the flow rate of air through conduit 24 required for complete combustion of the fuels flowing through conduits 21 and 23. Again, it is noted that in some cases it may be desired to supply excess air. Signal 91 is provided as the set point input to the flow controller 92.

Flow transducer 94 in combination with the flow sensor 95, which is operably located in conduit 24, provides an output signal 96 which is representative of the actual flow rate of air through conduit 24. Signal 96 is supplied from the flow transducer 94 as the process variable input to the flow controller 92.

In response to signals 91 and 96, the flow controller 92 provides an output signal 97 which is responsive to the difference between signals 91 and 96. Signal 97 is scaled so as to be representative of the position of the control valve 98, which is operably located in conduit 24, required to maintain the actual flow rate of air through conduit 24 substantially equal to the desired flow rate represented by signal 91. Signal 97 is provided from the flow controller 92 as a control signal for the control valve 98 and the control valve 98 is manipulated in response thereto.

Figure 2:
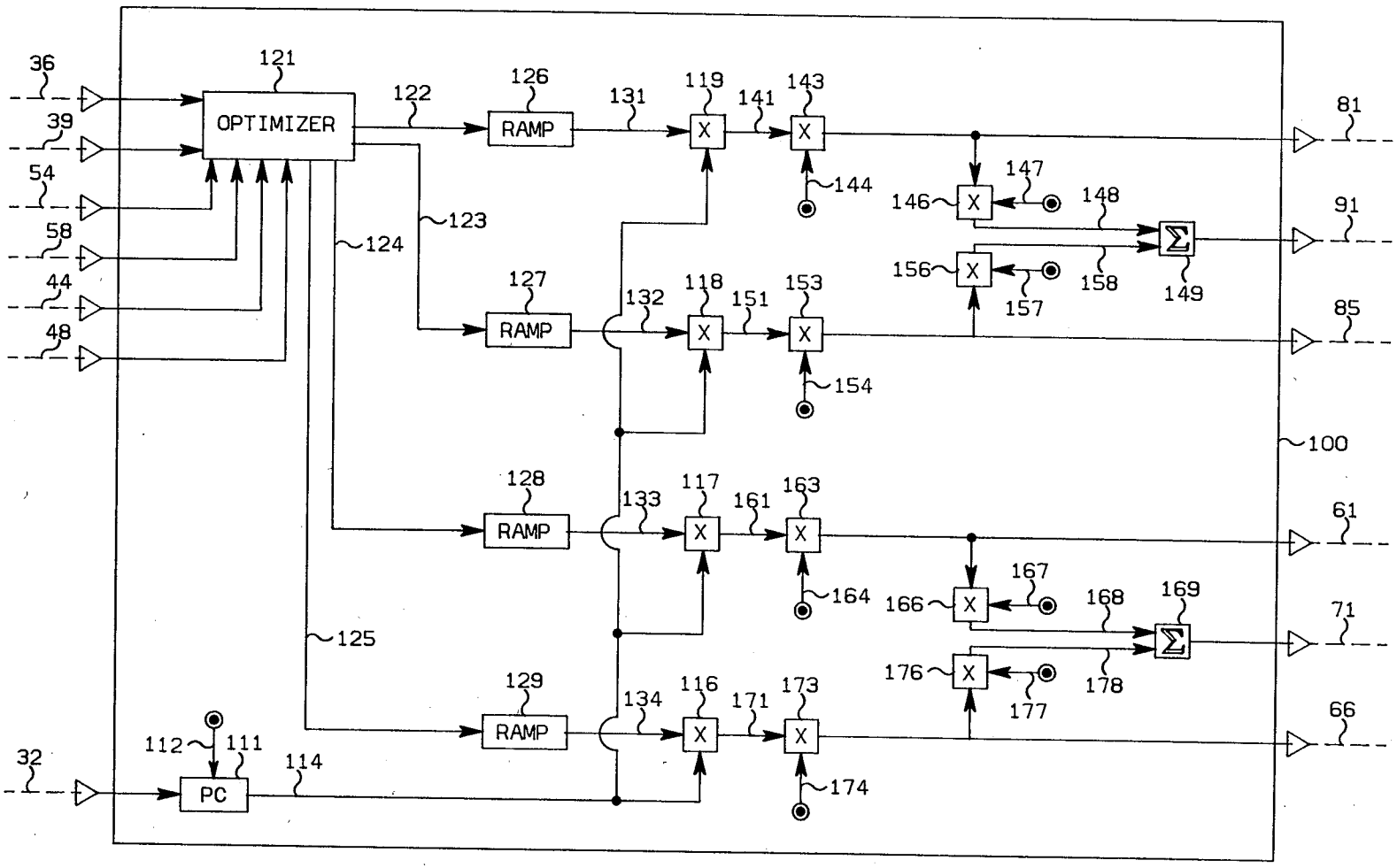
FIG. 2 is a diagrammatic illustration of the computer logic utilized to generate the control signals illustrated in FIG. 1 based on the process measurements illustrated in FIG. 1.

Referring now to FIG. 2, signal 32 which is representative of the actual header pressure, is supplied as the process variable input to the pressure controller 111. The pressure controller 111 is also supplied with a set point signal 112 which is representative of the desired header pressure.

In response to signals 32 and 112, the pressure controller 111 provides an output signal 114 which is responsive to the difference between signals 32 and 112. Signal 114 is scaled so as to be representative of the total number of BTU's per hour which must be supplied to boilers 11 and 12 in order to maintain the actual header pressure substantially equal to the desired header pressure represented by signal 112. Signal 114 is provided from pressure controller 111 as a first input to the multiplying blocks 116–119.

Signal 36 which is representative of the actual flow rate of steam from the boiler 11 and signal 39 which is representative of the actual flow rate of steam from the boiler 12 are provided as inputs to the optimizer 121. Also, signals 44, 48, 54 and 58 which are representative of fuel flow rates are provided to the optimizer 121.

The optimizer 121 will be described more fully hereinafter in conjunction with FIG. 3. However, essentially the optimizer 121 determines the optimum mix of the primary fuel and secondary fuel for boiler 11 and boiler 12 and also determines the optimum BTU's which should be provided to boiler 11 and boiler 12 in order to maintain the desired header pressure. This optimization is embodied in four output signals which are described hereinafter.

Signal 122 is representative of the percentage of the total heat required per unit time, as represented by signal 114, which should be supplied by the primary fuel to boiler 11 in order to substantially maximize the energy efficiency of boilers 11 and 12. In like manner, signal 123 is representative of the percentage of the total heat per unit time represented by signal 114 which should be supplied by the supplemental fuel to boiler 11.

Signal 124 is representative of the percentage of the total heat per unit time represented by signal 114 which should be supplied by the primary fuel to boiler 12 and signal 125 is representative of the percentage of the total heat per unit time represented by signal 114 which should be supplied by the secondary fuel to boiler 12. Signals 122–125 are provided from the optimizer 121 to ramp blocks 126–129 respectively.

The use of the ramp blocks 126–129 is desirable but is not required. The ramp blocks 126–129 are conventional and are utilized to prevent signals 122–125 from making a step change. Thus, if signal 122 is representative of 40% at a time $T_1$ and is then changed to 50% by the optimizer 121 at a time $T_2$, signal 131, which is provided as an output from the ramp block 126, would not immediately change to 50% but would slowly change to 50% over a period of time. This prevents a step change in the percentage value represented by signal 122 from causing a process disruption.

In like manner, ramps 127–129 are utilized to prevent a step change in signals 123–125 from causing a process disruption by causing signals 132–134 to slowly assume the new value of signals 123–125 respectively.

Signal 131 is provided from the ramp 126 as a second input to the multiplying block 119. In like manner, signals 132–134 are provided from the ramp blocks 127–129 as second inputs to the multiplying blocks 116–118 respectively.

Signal 114 is multiplied by signal 131 in the multiplying block 119 to establish signal 141 which is representative of the number of BTU's per unit time which should be supplied by the primary fuel to the boiler 11. Signal 141 is supplied from the multiplying block 119 as a first input to the multiplying block 143.

The multiplying block 143 is also supplied with signal 144 which is representative of the number of cubic feet of the primary fuel (assuming a gaseous fuel) which must be combusted to supply one BTU. Generally, the value of signal 144 will be known for the primary fuel. However, if this value is not known or changes periodically, the value may be determined by conventional analysis.

Signal 141 is multiplied by signal 144 to establish signal 81 which is representative of the desired flow rate of primary fuel to the burner 22 associated with the boiler 11. Signal 81 is provided as a process control signal output from computer 100 and is utilized as previously described. Also, signal 81 is supplied as a first input to the multiplying block 146.

The multiplying block 146 is also supplied with signal 147 which is representative of the number of cubic feet of air which must be supplied for complete combustion of a cubic foot of the primary fuel flowing through conduit 21. The value for signal 147 will generally be known for any particular fuel. Also, it is noted that, if excess air is desired, the ratio represented by signal 147 can be increased to provide the desired percentage of excess air.

Signal 81 is multiplied by signal 147 to establish signal 148 which is representative of the desired flow rate of air through conduit 24 for the primary fuel. Signal 148 is provided as a first input to the summing block 149.

Signal 114 is multiplied by signal 132 in the multiplying block 118 to establish signal 151 which is representative of the number of BTU's per unit time which should be supplied by the secondary fuel to the boiler 11. Signal 151 is supplied from the multiplying block 118 as a first input to the multiplying block 153.

The multiplying block 153 is also supplied with signal 154 which is representative of the number of cubic feet of the secondary fuel (assuming a gaseous fuel) which must be combusted to supply one BTU. Generally, the value of signal 154 will be known for the secondary fuel. However, if this value is not known or changes periodically, the value may be determined by conventional analysis.

Signal 151 is multiplied by signal 154 to establish signal 85 which is representative of the desired flow rate of secondary fuel to the burner 22 associated with the boiler 11. Signal 85 is provided as a process control signal output from computer 100 and is utilized as previously described. Also, signal 85 is supplied as a first input to the multiplying block 156.

The multiplying block 156 is also supplied with signal 157 which is representative of the number of cubic feet of air which must be supplied for complete combustion of a cubic foot of the secondary fuel flowing through conduit 23. Again, the value for signal 157 will generally be known for any particular fuel. Also, it is again noted that, if excess air is desired, the ratio represented by signal 157 can be increased to provide the desired percentage of excess air.

Signal 85 is multiplied by signal 157 to establish signal 158 which is representative of the desired flow rate of air through conduit 24 for the secondary fuel. Signal 158 is provided as a second input to the summing block 149.

Signals 148 and 158 are summed to establish signal 91 which is representative of the total desired flow rate of air through conduit 24. Signal 91 is provided as a process control signal output from computer 100 and is utilized as previously described.

Signal 114 is multiplied by signal 133 in the multiplying block 117 to establish signal 161 which is representative of the number of BTU's per unit time which should be supplied by the primary fuel to the boiler 12. Signal 161 is supplied from the multiplying block 117 as a first input to the multiplying block 163.

The multiplying block 163 is also supplied with signal 164 which is representative of the number of cubic feet of primary fuel (assuming a gaseous fuel) which must be combusted to supply one BTU. Again, the value of signal 164 will be known for the primary fuel flowing through conduit 25 and signal 164 would be the same as signal 144 is the two fuels are the same. However, if this value is not known or changes periodically, the valve may be determined by conventional analysis.

Signal 161 is multiplied by signal 164 to establish signal 61 which is representative of the desired flow rate of primary fuel to the burner 26 associated with the boiler 12. Signal 61 is provided as a process control signal output from computer 100 and is utilized as previously described. Also, signal 61 is supplied as a first input to the multiplying block 166.

The multiplying block 166 is also supplied with signal 167 which is representative of the number of cubic feet of air which must be supplied for complete combustion of a cubic foot of the primary fuel flowing through conduit 25. Again, the value for signal 167 will generally be known for any particular fuel and will again be the same as signal 147 if the two fuels are the same. The ratio represented by signal 167 can be increased to provide any excess air desired.

Signal 61 is multiplied by signal 167 to establish signal 168 which is representative of the desired flow rate of air through conduit 27 for the primary fuel. Signal 68 is provided as a first input to the summing block 169.

Signal 114 is multiplied by signal 134 in the multiplying block 116 to establish signal 171 which is representative of the number of BTU's per unit time which should be supplied by the secondary fuel to the boiler 12. Signal 171 is supplied from the multiplying block 116 as a first input to the multiplying block 173.

The multiplying block 173 is also supplied with signal 174 which is representative of the number of cubic feet of secondary fuel (assuming a gaseous fuel) which must be combusted to supply one BTU. Again, the value of signal 174 will be known for the secondary fuel flowing through conduit 25 and signal 174 would be the same as signal 154 if the two fuels are the same. However, if this value is not known or changes periodically, the value may be determined by conventional analysis.

Signal 171 is multiplied by signal 174 to establish signal 66 which is representative of the desired flow rate of secondary fuel to the burner 26 associated with the boiler 12. Signal 66 is provided as a process control signal output from computer 100 and is utilized as previously described. Also, signal 66 is supplied as a first input to the multiplying block 176.

The multiplying block 176 is also supplied with signal 177 which is representative of the number of cubic feet of air which must be supplied for complete combustion of a cubic foot of the secondary fuel flowing through conduit 28. Again, the value for signal 177 will generally be known for any particular fuel and will again be the same as signal 157 if the two fuels are the same. The ratio represented by signal 177 can be increased to provide any excess air desired.

Signal 66 is multiplied by signal 177 to establish signal 178 which is representative of the desired flow rate of air through conduit 27 for the secondary fuel. Signal 178 is provided as a second input to the summing block 169.

Signals 168 and 178 are summed to establish signal 71 which is representative of the total desired flow rate of air through conduit 27. Signal 71 is provided as a process control signal output from computer 100 and is utilized as previously described.

For any particular boiler, the cost of producing steam (COST) is given by Equation 1

$$\text{COST}=[(FP\times P\$)+(FS+S\$)]\times EFF \tag{1}$$

where FP=the flow rate of the primary fuel in BTU's per hour;

P$=the cost per BTU of the primary fuel;

FS=the flow rate of the secondary fuel in BTU's per hour; and

Ss=the cost per BTU of the secondary fuel, and

EFF=the efficiency of the boiler.

An equation which can be used to determine the efficiency of a boiler (EFF) is given by Equation 2.

$$EFF=A+B\times E+C\times E^2+W\times FS/FT+-Q\times E\times FS/FT \tag{2}$$

where

E=the flow rate of steam from the boiler in pounds per hour;

FS is as previously defined;

FT=the sum of FS and FP as previously defined; and

A, B, C, W and Q are constants.

Equation 2 is a form of a regression equation. The constants are determined by measuring an actual efficiency and measuring an actual steam rate and fuel flow rates. Equation 2 is then solved using these measured values to determine the set of constants which will best match the left and right sides of the Equation 2. This is a conventional technique for determining the constants required for a regression equation of the form of Equation 2.

Figure 3:
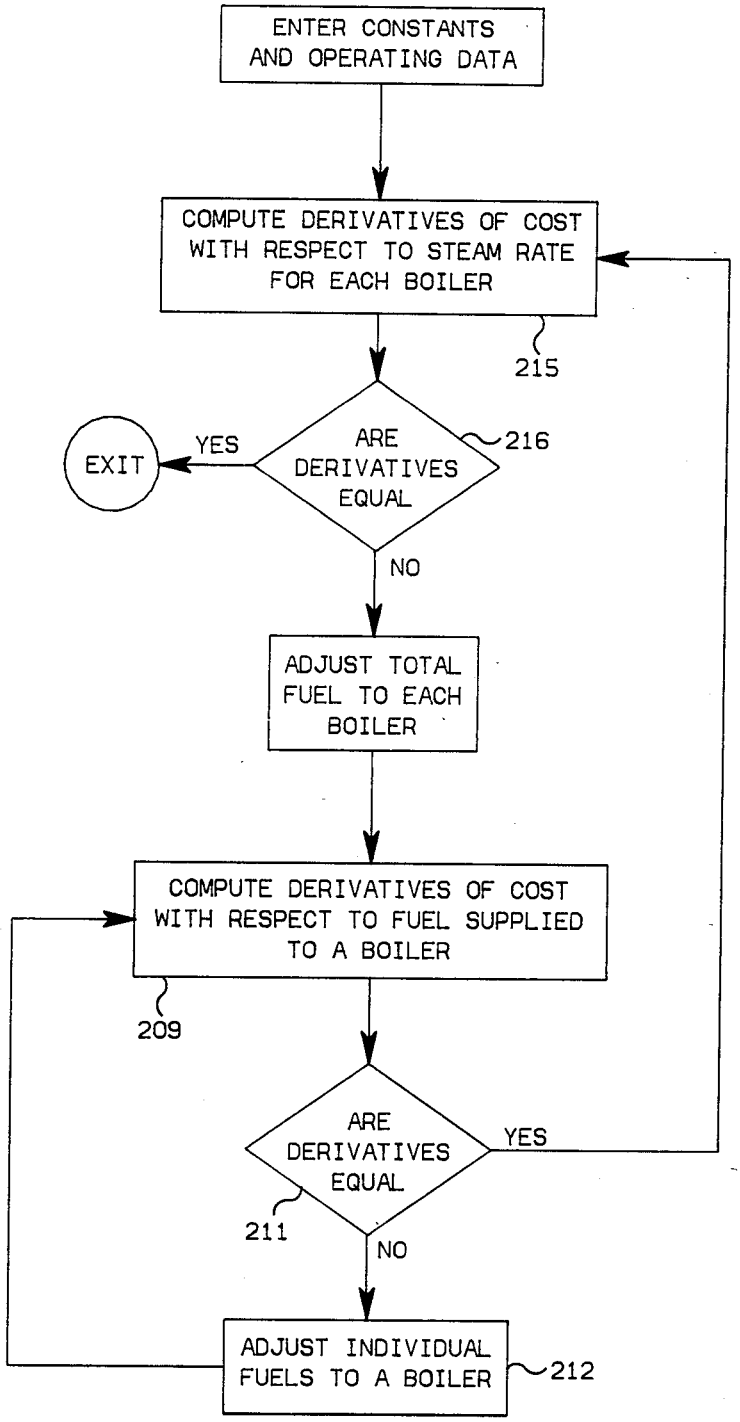
FIG. 3 is a flow chart diagram of the optimizer illustrated in FIG. 2.

Referring now to FIG. 3, the constants A, B, C, W and Q are entered and also the operating data (FP, FS and E) are entered. It is noted that FP and FS, as measured, will be in a unit such as pounds per hour. The measured flow rate is converted to the BTU per hour units required by Equations 1 and 2 by multiplying by the BTU content of the fuel. The cost per BTU of each fuel is also entered.

It is noted that, for any boiler, the constants and the operating data will vary. Thus, the constants and operating data are entered for both boiler 11 and boiler 12.

For a full description of FIG. 3, the computation embodied in the block 209 entitled "Compute Derivatives of Cost With Respect to Fuel Supply to a Boiler" will first be examined. This computation is made to optimize the fuel mix provided to any particular boiler.

In order to substantially optimize the fuel mix provided to a particular boiler, the derivative of cost with respect to the secondary fuel for Equation 1 and the derivative cost with respect to the primary fuel for Equation 1 should be substantially equal. Thus, these two derivatives are calculated and compared by the decision block 211.

The equation utilized to calculate the derivative of cost with respect to the secondary fuel is given by Equation 3

$$\frac{d\,\text{COST}}{ds}= \tag{3}$$

$$S\$[(K\times Y-K\times C\times E^2-Z\times B-$$

$$2\times Z\times C\times E-Z\times Q)/(Y+B\times E+$$

-continued $$C \times E^2 + Q \times E)^2]$$

where S$, E, B, C and Q are as previously defined. The term Y in Equation 3 is given by Equation 4

$$Y = A + W \quad (4)$$

where A and W are as previously defined. The term Z in Equation 3 is given by Equation 5

$$Z = W \times FP \quad (5)$$

where W and FP are as previously defined. The term K in Equation 3 is given by Equation 6

$$K = G - Q \times FP \quad (6)$$

where Q and FP are as previously defined. The term G in Equation 6 is given by Equation 7

$$G = 0.001[(H(2) - H(1)) + BDF \times (H(3) - H(1))] \quad (7)$$

where

H(2)=the enthalpy of the steam provided from the boiler;

H(1)=the enthalpy of the feed water provided to a boiler;

H(3)=the enthalpy of the blowdown stream; and

BDF=the percent of the feedwater which is withdrawn as blowdown.

The derivative of cost with respect to the primary fuel is given by Equation 8

$$\frac{d\,\mathrm{COST}}{dp} = \quad (8)$$

$$P\$[(A \times G - C \times G \times E^2 + M \times B + 2 \times C \times E \times M + N \times (C \times E^2 - A))/(A + B \times E + C \times E^2)^2]$$

where all variables except M and N are as previously defined.

The value of M is given by Equation 9

$$M = W \times FS \quad (9)$$

where W and FS are as previously defined. The value of N is given by Equation 10

$$N = Q \times FS \quad (10)$$

where Q and FS are as previously defined.

As previously stated, both Equations 3 and 8 are solved in block 209 for boiler 11 and the results of the solution are checked in block 211. If the derivatives are equal, the fuel mix provided to boiler 11 will be optimum. If the derivatives are not equal, then the individual fuel rates are adjusted in block 212 with respect to each other and the derivatives are then recalculated.

The adjustment to be made is determined by the magnitude of the difference between the derivatives of cost with respect to the primary and secondary fuels. Essentially, if the derivative of cost with respect to the primary fuel is greater than the derivative of cost with respect to the secondary fuel then the flow rate of the primary fuel will be decreased and the flow rate of the secondary fuel will be increased.

After a short time, the optimum flow rates of the primary fuel and the secondary fuel to the boiler 11 will have been determined. The procedure is then repeated for boiler 12.

After the individual flow rates of fuel to boilers 11 and 12 have been optimized, the derivative of cost with respect to the steam rate for each boiler is then determined in block 215. This derivative for boiler 11 is the sum of the results of Equations 3 and 8, when an optimum is reached, for boiler 11. In like manner, this derivative for boiler 12 is the sum of Equations 3 and 8, when an optimum is reached, for boiler 12. The derivatives determined for boilers 11 and 12 are then checked in block 216 to determine if the derivatives are substantially equal. If the derivatives are substantially equal then an optimum for boilers 11 and 12 has been reached and signals 122–125 are output from the optimizer 121 as previously described. However, if the derivatives are not equal, then the total fuel to boiler 11 is adjusted with respect to the total fuel to boiler 12. However, the ratio established by the optimization in blocks 209, 211 and 212 is not changed. As was the case with the derivatives of cost with respect to fuel, if the derivative of cost with respect to steam rate for boiler 11 is higher than the derivative of cost with respect to steam rate for boiler 12, then the total fuel to boiler 11 will be reduced and the total fuel to boiler 12 will be increased.

After the total fuel to each boiler is adjusted, the derivatives of cost with respect to fuel are again calculated in block 209. This procedure is continued until the derivatives of cost with respect to steam rate for boilers 11 and 12 are substantially equal.

In summary, a comparison of actual header pressure to desired header pressure is utilized to determine the total heat per unit time which must be supplied to the parallel boilers 11 and 12. Optimization is then utilized to determine what percentage of the total heat should be supplied to each of the boilers 11 and 12 and how this heat should be provided (ratio of primary and secondary fuel) to substantially maximize the energy efficiency of boilers 11 and 12 while still maintaining the desired header pressure. Control of the desired header pressure with optimization is thus accomplished on-line even with multiple fuels which is extremely desirable in many processes which are highly automated.

The invention has been described in terms of a preferred embodiment as illustrated in FIGS. 1, 2 and 3. Control components illustrated in FIG. 1 such as pressure transducer 31; flow transducers 33, 37, 41, 46, 94, 51, 56 and 74; flow sensors 34, 38, 42, 47, 95, 52, 57 and 75; flow controllers 45, 49, 92, 55, 59 and 72 and control valves 84, 88, 98, 64, 69 and 78 are each well-known, commercially available components such as are illustrated and described in Perry's Chemical Engineers Handbook, 4th Edition, Chapter 22, McGraw-Hill.

While the invention has been described in terms of the presently preferred embodiment, reasonable variations and modifications are possible by those skilled in the art. Such variations and modifications are within the scope of the described invention as claimed.

That which is claimed is:

1. Apparatus comprising:

a first boiler having a first burner associated therewith;

means for supplying a first fuel stream to said first burner;

means for supplying a second fuel stream to said first burner;

means for supplying a first air stream to said first burner, wherein the combustion of said first fuel stream and said second fuel stream with said first air stream at said first burner supplies heat to said first boiler and wherein said first fuel stream has a different BTU content than said second fuel stream;

a header conduit;

means for supplying steam from said first boiler to said header conduit;

a second boiler having a second burner associated therewith;

means for supplying a third fuel stream to said second burner;

means for supplying a fourth fuel stream to said second burner;

means for supplying a second air stream to said second burner, wherein the combustion of said third fuel stream and said fourth fuel stream with said second air stream at said second burner supplies heat to said second boiler and wherein said third fuel stream has a different BTU content than said fourth fuel stream;

means for supplying steam from said second boiler to said header conduit;

means for establishing a first signal representative of the pressure in said header conduit;

means for establishing a second signal representative of the desired pressure in said header conduit;

means for comparing said first signal and said second signal and for establishing a third signal which is responsive to the difference between said first signal and said second signal, wherein said third signal is scaled so as to be representative of the total heat per unit time which must be supplied to said first boiler and said second boiler by the combustion of said first, second, third and fourth fuel streams in order to maintain the actual pressure in said header conduit substantially equal to the desired pressure represented by said second signal;

means for establishing a fourth signal representative of the actual flow rate of steam from said first boiler to said header conduit;

means for establishing a fifth signal representative of the actual flow rate of steam from said second boiler to said header conduit;

means for establishing a sixth signal representative of the actual flow rate of said first fuel to said first burner;

means for establishing a seventh signal representative of the actual flow rate of said second fuel to said first burner;

means for establishing an eighth signal representative of the actual flow rate of said third fuel to said second burner;

means for establishing a ninth signal representative of the actual flow rate of said fourth fuel to said second burner;

means for establishing, in response to said fourth through ninth signals, a tenth signal representative of the percentage of the total heat per unit time represented by said third signal which should be supplied to said first boiler by said first fuel in order to substantially optimize the energy efficiency of said first boiler and said second boiler;

means for multiplying said third signal by said tenth signal to establish an eleventh signal representative of the heat per unit time which must be supplied to said first boiler by the combustion of said first fuel stream;

means for manipulating the flow of said first fuel stream in response to said eleventh signal;

means for establishing, in response to said fourth through ninth signals, a twelfth signal representative of the percentage of the total heat per unit time represented by said third signal which must be supplied to said first boiler by said second fuel stream in order to substantially maximize the energy efficiency of said first and second boilers;

means for multiplying said third signal by said twelfth signal to establish a thirteenth signal which is representative of the total heat per unit time which must be supplied to said first boiler by the combustion of said second fuel stream;

means for manipulating the flow of said second fuel stream to said first burner in response to said thirteenth signal;

means for manipulating the flow of said first air stream to said first burner in response to the combination of said eleventh signal and said thirteenth signal;

means for establishing, in response to said fourth through ninth signals, a fourteenth signal representative of the percentage of the total heat per unit time represented by said third signal which should be supplied to said second boiler by said third fuel stream in order to substantially optimize the energy efficiency of said first boiler and said second boiler;

means for multiplying said third signal by said fourteenth signal to establish a fifteenth signal representative of the heat per unit time which must be supplied to said second boiler by the combustion of said third fuel stream;

means for manipulating the flow of said third fuel stream to said second burner in response to said fifteenth signal;

means for establishing, in response to said fourth through ninth signals, a sixteenth signal representative of the percentage of the total heat per unit time represented by said third signal which must be supplied to said second boiler by said fourth fuel stream in order to substantially maximize the energy efficiency of said first and second boilers;

means for multiplying said third signal by said sixteenth signal to establish a seventeenth signal which is representative of the total heat per unit time which must be supplied to said second boiler by the combustion of said fourth fuel stream;

means for manipulating the flow of said fourth fuel stream to said second burner in response to said seventeenth signal; and means for manipulating the flow of said second air stream to said second burner in response to the combination of said fifteenth signal and said seventeenth signal.

2. Apparatus in accordance with claim 1 wherein said means for manipulating the flow of said first fuel stream to said first burner, said means for manipulating the flow of said second fuel stream to said first burner, said means for manipulating the flow of said first air stream to said first burner, said means for manipulating the flow of said third fuel stream to said second burner, said means for manipulating the flow of said fourth fuel stream to said second burner and said means for manipulating the flow of said second air stream to said second burner comprises:

a first control valve operably located so as to control the flow of said first fuel stream;

a second control valve operably located so as to control the flow of said second fuel stream;

a third control valve operably located so as to control the flow of said first air stream;

a fourth control valve operably located so as to control the flow of said third fuel stream;

a fifth control valve operably located so as to control the flow of said fourth fuel stream;

a sixth control valve operably located so as to control the flow of said second air stream;

means for establishing an eighteenth signal representative of the amount of said first fuel stream which must be combusted in order to supply one BTU, wherein the fuel in said third fuel stream is the same as the fuel in said first fuel stream;

means for multiplying said eleventh signal by said eighteenth signal to establish a nineteenth signal representative of the flow rate of said first fuel stream required to supply the heat per unit time represented by said eleventh signal;

means for establishing a twentieth signal representative of the actual flow rate of the said first fuel stream;

means for comparing said nineteenth signal and said twentieth signal and for establishing a twenty first signal which is responsive to the difference between said nineteenth signal and said twentieth signal, wherein said twenty first signal is scaled so as to be representative of the position of said first control valve required to maintain the actual flow rate of said first fuel stream substantially equal to the desired flow rate represented by said nineteenth signal;

means for manipulating said first control valve in response to said twenty first signal;

means for establishing a twenty second signal representative of the amount of said second fuel stream which must be combusted in order to supply one BTU, wherein the fuel in said fourth fuel stream is the same as the fuel in said second fuel stream;

means for multiplying said thirteenth signal by said twenty second signal to establish a twenty third signal representative of the flow rate of said second fuel stream required to supply the heat per unit time represented by said thirteenth signal;

means for establishing a twenty fourth signal representative of the actual flow rate of said second fuel stream;

means for comparing said twenty third signal and said twenty fourth signal and for establishing a twenty fifth signal which is responsive to the difference between said twenty third signal and said twenty fourth signal, wherein said twenty fifth signal is scaled so as to be representative of the position of said second control valve required to maintain the actual flow rate of said second fuel stream substantially equal to the desired flow rate represented by said twenty third signal;

means for manipulating said second control valve in response to said twenty fifth signal;

means for establishing a twenty sixth signal representative of the desired air to fuel ratio for said first fuel stream;

means for multiplying said nineteenth signal by said twenty sixth signal to establish a twenty seventh signal which is representative of the desired flow rate of said first air stream for said first fuel stream;

means for establishing a twenty eighth signal representative of the desired air to fuel ratio for said second fuel stream;

means for multiplying said twenty third signal by said twenty eighth signal to establish a twenty ninth signal representative of the desired flow rate of said first air stream for said second fuel stream;

means for summing said twenty seventh signal and said twenty ninth signal to establish a thirtieth signal representative of the desired total flow rate of said first air stream;

means for establishing a thirty first signal representative of the actual flow rate of said first air stream;

means for comparing said thirtieth signal and said thirty first signal and for establishing a thirty second signal which is responsive to the difference between said thirtieth signal and said thirty first signal, wherein said thirty second signal is scaled so as to be representative of the position of said third control valve required to maintain the actual flow rate of said first air stream substantially equal to the desired flow rate represented by said thirtieth signal;

means for manipulating said third control valve in response to said thirty second signal;

means for multiplying said fifteenth signal by said eighteenth signal to establish a thirty third signal representative of the flow rate of said third fuel stream required to supply the heat per unit time represented by said fifteenth signal;

means for establishing a thirty fourth signal representative of the actual flow rate of the said first fuel stream;

means for comparing said thirty third signal and said thirty fourth signal and for establishing a thirty fifth signal which is responsive to the difference between said thirty third signal and said thirty fourth signal, wherein said thirty fifth signal is scaled so as to be representative of the position of said fourth control valve required to maintain the actual flow rate of said third fuel stream substantially equal to the desired flow rate represented by said thirty third signal;

means for manipulating said fourth control valve in response to said thirty third signal;

means for multiplying said seventeenth signal by said twenty second signal to establish a thirty sixth signal representative of the flow rate of said fourth fuel stream required to supply the heat per unit time represented by said seventeenth signal;

means for establishing a thirty seventh signal representative of the actual flow rate of said fourth fuel stream;

means for comparing said thirty sixth signal and said thirty seventh signal and for establishing a thirty eighth signal which is responsive to the difference between said thirty sixth signal and said thirty seventh signal, wherein said thirty eighth signal is scaled so as to be representative of the position of said fifth control valve required to maintain the actual flow rate of said fourth fuel stream substantially equal to the desired flow rate represented by said thirty sixth signal;

means for manipulating said fifth control valve in response to said thirty eighth signal;

means for establishing a thirty ninth signal representative of the desired air to fuel ratio for said third fuel stream;

means for multiplying said thirty third signal by said thirty ninth signal to establish a fortieth signal which is representative of the desired flow rate of said second air stream for said third fuel stream;

means for establishing a forty first signal representative of the desired air to fuel ratio for said fourth fuel stream;

means for multiplying said thirty sixth signal by said forty first signal to establish a forty second signal representative of the desired flow rate of said second air stream for said fourth fuel stream;

means for summing said fortieth signal and said forty second signal to establish a forty third signal representative of the desired total flow rate of said second air stream;

means for establishing a forty fourth signal representative of the actual flow rate of said second air stream;

means for comparing said forty third signal and said forty fourth signal and for establishing a forty fifth signal which is responsive to the difference between said forty third signal and said forty fourth signal, wherein said forty fifth signal is scaled so as to be representative of the position of said sixth control valve required to maintain the actual flow rate of said second air stream substantially equal to the desired flow rate represented by said forty third signal;

means for manipulating said sixth control valve in response to said forty fifth signal.

3. A method for manipulating the flow of a first fuel stream, a second fuel stream and a first air stream to a first burner associated with a first boiler and for manipulating the flow of a third fuel stream, a fourth fuel stream and a second air stream to a second burner associated with a second boiler, wherein the combustion of said first fuel stream and said second fuel stream with said first air stream at said first burner supplies heat to said first boiler, wherein the combustion of said third fuel stream and said fourth fuel stream with said second air stream at said second burner supplies heat to said second boiler, wherein steam is supplied from said first boiler and from said second boiler to a header conduit, wherein said first fuel stream has a different BTU content than said second fuel stream and wherein said third fuel stream has a different BTU content than said fourth fuel stream, said method comprising the steps of:

establising a first signal representative of the pressure in said header conduit;

establishing a second signal representative of the desired pressure in said header conduit;

comparing said first signal and said second signal and establishing a third signal which is responsive to the difference between said first signal and said second signal, wherein said third signal is scaled so as to be representative of the total heat per unit time which must be supplied to said first boiler and said second boiler by the combustion of said first, second, third and fourth fuel streams in order to maintain the actual pressure in said header conduit substantially equal to the desired pressure represented by said second signal;

establishing a fourth signal representative of the actual flow rate of steam from said first boiler to said header conduit;

establishing a fifth signal representative of the actual flow rate of steam from said second boiler to said header conduit;

establishing a sixth signal representative of the actual flow rate of said first fuel to said first burner;

establishing a seventh signal representative of the actual flow rate of said second fuel to said first burner;

establishing an eighth signal representative of the actual flow rate of said third fuel to said second burner;

establishing a ninth signal representative of the actual flow rate of said fourth fuel to said second burner;

establishing, in response to said fourth through ninth signals, a tenth signal representative of the percentage of the total heat per unit time represented by said third signal which should be supplied to said first boiler by said first fuel in order to substantially optimize the energy efficiency of said first boiler and said second boiler;

multiplying said third signal by said tenth signal to establish an eleventh signal representative of the heat per unit time which must be supplied to said first boiler by the combustion of said first fuel stream;

manipulating the flow of said first fuel stream in response to said eleventh signal;

establishing, in response to said fourth through ninth signals, a twelfth signal representative of the percentage of the total heat per unit time represented by said third signal which must be supplied to said first boiler by said second fuel stream in order to substantially maximize the energy efficiency of said first and second boilers;

multiplying said third signal by said twelfth signal to establish a thirteenth signal which is representative of the total heat per unit time which must be supplied to said first boiler by the combustion of said second fuel stream;

manipulating the flow of said second fuel stream to said first burner in response to said thirteenth signal;

manipulating the flow of said first air stream to said first burner in response to the combination of said eleventh signal and said thirteenth signal;

establishing, in response to said fourth through ninth signals, a fourteenth signal representative of the percentage of the total heat per unit time represented by said third signal which should be supplied to said second boiler by said third fuel stream in order to substantially optimize the energy efficiency of said first boiler and said second boiler;

multiplying said third signal by said fourteenth signal to establish a fifteenth signal representative of the heat per unit time which must be supplied to said second boiler by the combustion of said third fuel stream;

manipulating the flow of said third fuel stream to said second burner in response to said fifteenth signal;

establishing, in response to said fourth through ninth signals, a sixteenth signal repesentative of the percentage of the total heat per unit time represented by said third signal which must be supplied to said second boiler by said fourth fuel stream in order to substantially maximize the energy efficiency of said first and second boilers;

multiplying said third signal by said sixteenth signal to establish a seventeenth signal which is representative of the total heat per unit time which must be supplied to said second boiler by the combustion of said fourth fuel stream;

manipulating the flow of said fourth fuel stream to said second burner in response to said seventeenth signal; and manipulating the flow of said second air stream to said second burner in response to the combination of said fifteenth signal and said seventeenth signal.

4. A method in accordance with claim 3 wherein said step of manipulating the flow of said first fuel stream to said first burner, said step of manipulating the flow of said second fuel stream to said first burner, said step of manipulating the flow of said first air stream to said first burner, said step of manipulating the flow of said third fuel stream to said second burner, said step of manipulating the flow of said fourth fuel stream to said second burner and said step of manipulating the flow of said second air stream to said second burner comprises:

establishing an eighteenth signal representative of the amount of said first fuel stream which must be combusted in order to supply one BTU, wherein the fuel in said third fuel stream is the same as the fuel in said first fuel stream;

multiplying said eleventh signal by said eighteenth signal to establish a nineteenth signal representative of the flow rate of said first fuel stream required to supply the heat per unit time represented by said eleventh signal;

establishing a twentieth signal representative of the actual flow rate of the said first fuel stream;

comparing said nineteenth signal and said twentieth signal and establishing a twenty first signal which is responsive to the difference between said nineteenth signal and said twentieth signal, wherein said twenty first signal is scaled so as to be representative of the position of a first control valve, which is operably located so as to control the flow of said first fuel stream, required to maintain the actual flow rate of said first fuel stream substantially equal to the desired flow rate repesented by said nineteenth signal;

manipulating said first control valve in response to said twenty first signal;

establishing a twenty second signal representative of the amount of said second fuel stream which must be combusted in order to supply one BTU, wherein the fuel in said fourth fuel stream is the same as the fuel in said second fuel stream;

multiplying said thirteenth signal by said twenty second signal to establish a twenty third signal representative of the flow rate of said second signal required to supply the heat per unit time represented by said thirteenth signal;

establishing a twenty fourth signal representative of the actual flow rate of said second fuel stream;

comparing said twenty third signal and said twenty fourth signal and establishing a twenty fifth signal which is responsive to the difference between said twenty third signal and said twenty fourth signal, wherein said twenty fifth signal is scaled so as to be representative of the position of a second control valve, which is operably located so as to control the flow of said second fuel stream, required to maintain the actual flow rate of said second fuel stream substantially equal to the desired flow rate represented by said twenty third signal;

manipulating said second control valve in response to said twenty fifth signal;

establishing a twenty sixth signal representative of the desired air to fuel ratio for said first fuel stream;

multiplying said nineteenth signal by said twenty sixth signal to establish a twenty seventh signal which is representative of the desired flow rate of said first air stream for said first fuel stream;

establishing a twenty eighth signal representative of the desired air to fuel ratio for said second fuel stream;

multiplying said twenty third signal by said twenty eighth signal to establish a twenty ninth signal representative of the desired flow rate of said first air stream for said second fuel stream;

summing said twenty seventh signal and said twenty ninth signal to establish a thirtieth signal representative of the desired total flow rate of said first air stream;

establishing a thirty first signal representative of the actual flow rate of said first air stream;

comparing said thirtieth signal and said thirty first signal and for establishing a thirty second signal which is responsive to the difference between said thirtieth signal and said thirty first signal, wherein said thirty second signal is scaled so as to be representative of the position of a third control valve, which is operably located so as to control the flow of said first air stream, required to maintain the actual flow rate of said first air stream substantially equal to the desired flow rate represented by said thirtieth signal;

manipulating said third control valve in response to said thirty second signal;

multiplying said fifteenth signal by said eighteenth signal to establish a thirty third signal representative of the flow rate of said third fuel stream required to supply the heat per unit time represented by said fifteenth signal;

establishing a thirty fourth signal representative of the actual flow rate of the said first fuel stream;

comparing said thirty third signal and said thirty fourth signal and establishing a thirty fifth signal which is responsive to the difference between said thirty third signal and said thirty fourth signal, wherein said thirty fifth signal is scaled so as to be representative of the position of a fourth control valve, which is operably located so as to control the flow of said third fuel stream, required to maintain the actual flow rate of said third fuel stream substantially equal to the desired flow rate represented by said thirty third signal;

manipulating said fourth control valve in response to said thirty third signal;

multiplying said seventeenth signal by said twenty second signal to establish a thirty sixth signal representative of the flow rate of said fourth fuel stream required to supply the heat per unit time represented by said seventeenth signal;

establishing a thirty seventh signal representative of the actual flow rate of said fourth fuel stream;

comparing said thirty sixth signal and said thirty seventh signal and establishing a thirty eighth signal which is responsive to the difference between said thirty sixth signal and said thirty seventh signal, wherein said thirty eighth signal is scaled so as to be representative of the position of a fifth control valve, which is operably located so as to control the flow of said fourth fuel stream, required to maintain the actual flow rate of said fourth fuel stream substantially equal to the desired flow rate represented by said thirty sixth signal;

manipulating said fifth control valve in response to said thirty eighth signal;

establishing a thirty ninth signal representative of the desired air to fuel ratio for said third fuel stream;

means for multiplying said thirty third signal by said thirty ninth signal to establish a fortieth signal which is representative of the desired flow rate of said second air stream for said third fuel stream;

establishing a forty first signal representative of the desired air to fuel ratio for said fourth fuel stream;

multiplying said thirty sixth signal by said forty first signal to establish a forty second signal representative of the desired flow rate of said second air stream for said fourth fuel stream;

summing said fortieth signal and said forty second signal to establish a forty third signal representative of the desired total flow rate of said second air stream;

establishing a forty fourth signal representative of the actual flow rate of said second air stream;

comparing said forty third signal and said forty fourth signal and establishing a forty fifth signal which is responsive to the difference between said forty third signal and said forty fourth signal, wherein said forty fifth signal is scaled so as to be representative of the position of a sixth control valve, which is operably located so as to control the flow of said second air stream, required to maintain the actual flow rate of said second air stream substantially equal to the desired flow rate represented by said forty third signal;

manipulating said sixth control valve in response to said forty fifth signal.

* * * * *